United States Patent [19]

Blanchet-Fincher et al.

[11] Patent Number: 4,849,314

[45] Date of Patent: Jul. 18, 1989

[54] PHOTOHARDENABLE ELECTROSTATIC MASTER CONTAINING ELECTRON ACCEPTOR OR DONOR

[75] Inventors: Graciela B. Blanchet-Fincher; Curtis R. Fincher, Jr., both of Wilmington, Del.

[73] Assignee: E. I. Du Pont de Nemours and Company, Wilmington, Del.

[21] Appl. No.: 116,655

[22] Filed: Nov. 4, 1987

[51] Int. Cl.[4] ..... G03G 5/026

[52] U.S. Cl. ..... 430/49; 430/916; 430/281; 430/286; 430/288

[58] Field of Search ..... 430/49, 281, 920, 916, 430/945, 288, 926; 522/26, 2, 286

[56] References Cited

U.S. PATENT DOCUMENTS 3,286,025 11/1966 Ingersoll ..... 178/6.6
3,479,185 11/1969 Chambers et al. ..... 430/278
3,652,275 3/1972 Baum et al. ..... 430/269
3,844,790 10/1974 Chang et al. ..... 430/281

FOREIGN PATENT DOCUMENTS 0243934 11/1987 European Pat. Off. .

*Primary Examiner*—John L. Goodrow

[57] ABSTRACT

Photohardenable electrostatic master comprising an electrically conductive substrate, e.g., aluminized polyethylene terephthalate, bearing a layer of a photopolymer comprising an organic polymeric binder, compound having at least one ethylenically unsaturated group, photoinitiator and at least one organic electron acceptor or donor compound, e.g., the acceptor and donor having an oxidation potential of less than +2.5 eV and reduction potential larger than −3.0 eV, respectively. The photohardenable electrostatic master is used for electrostatic proofing, etc.

47 Claims, 1 Drawing Sheet

PHOTOHARDENABLE ELECTROSTATIC MASTER CONTAINING ELECTRON ACCEPTOR OR DONOR

TECHNICAL FIELD

This invention relates to a photohardenable element for use as an electrostatic master. More particularly this invention relates to a photohardenable electrostatic master wherein a layer of a photohardenable composition comprising a polymeric binder, ethylenically unsaturated compound, photoinitiator, and an electron donor or an electron acceptor is present on an electrically conductive substrate.

BACKGROUND OF THE INVENTION

Photopolymerizable compositions and films containing binder, monomer, initiator and chain transfer agent are described in the prior art and sold commercially. One important application of photopolymerizable layers is in graphic arts. Photopolymerizable layers on conductive supports currently may be used as electrostatic masters for analog color proofing and are considered as promising future materials to be developed for digital color proofing applications. For the analog color proofing application, a photopolymer layer is coated on an electrically coductive substrate and contact exposed with an ultraviolet (UV) source through a half tone color separation negative. The photopolymer hardens in the areas exposed with an ultraviolet source due to polymerization and remains in a softer state elsewhere. The differences in viscosity between the exposed and unexposed areas are apparent in the transport properties, i.e., the unexposed photopolymer conducts more electrostatic charge while the UV exposed areas are substantially less conductive. By subjecting the exposed photopolymer layer to a corona discharge a latent electrostatic image is obtained consisting of electrostatic charge remaining only in the nonconducting or exposed areas of the photopolymer layer. This latent image can then be developed by application of a liquid electrostatic toner to the surface. When the developer has the opposite charge as the corona charge, the developer selectively adheres to the exposed or polymerized areas of the photopolymer layer.

Although the use of photopolymers in electrophotography has been demonstrated and many formulations can be imaged; it did not appear possible, to produce a photopolymer electrostatic master that duplicates the imaging characteristics of a printing press. The printing industry evaluates image quality and characteristics by a simple method known as dot gain curves. Dot gain means dot growth and the relationship between dot growth versus dot area in the final image is known as a dot gain curve. In a dot gain curve the dot growth is plotted along the y-axis and the actual dot size in percent along the x-axis. The perfect fidelity in reproduction corresponds to zero gain. That is, the actual dot on paper has the same diameter as the corresponding dot on the separation negative. Of course, the desired gain (standard) is the one that duplicates the printing press, a round convex curve which peaks at a gain of about 17% for 50% dots as shown in FIG. 1 appended hereto.

We have discovered that the electrical properties of a photopolymer layer can be associated with the dot gain of the final image. Low or negative dot gains curves are associated with photopolymer compositions in which the amount of corona charge retained by the imagewise exposed dot area on the master is highly non-linearly related to the percent dot area in question. These photopolymer compositions also exhibit a large difference in the conductivity between the exposed and unexposed areas. The conductivity of the exposed area is controlled by the mobility of the ions in a glassy polymer while the conductivity of the exposed area is controlled by the mobility of the ions in a softer polymer. The ratio of the mobilities between these two areas is usually about $10^5$ to $10^6$. When the conductivity ratio is too large not only is the dot gain low but the image deteriorates. This also has undesirable consequence that the image on paper does not faithfully reproduce the contact negative or the printing press.

Photopolymer compositions prior to this invention show a negative or low dot gain due to the aforementioned problems with the contrast in electrical conductivities being too large and the relationship between charge retained and corresponding percent dot area being highly non-linear. The ability of controlling dot gain permits faithfully reproducing a printing press which is a necessity for the preparation of an electrostatic proof.

It has now been found that the conductivity of both the exposed and unexposed areas can be controlled by introducing into the photopolymer composition an electron donor or an electron acceptor molecule that modifies the electrical properties of the composition and provides a dot gain curve similar to that achieved by a printing press. It has also been found that on the latent electrostatic image the charge retained by each dot is almost linearly related to the percent dot area and, as a result, the thickness of the developer layer attracted to the photopolymer master is constant, independent of the dot pattern being developed.

SUMMARY OF THE INVENTION

Figure 1:
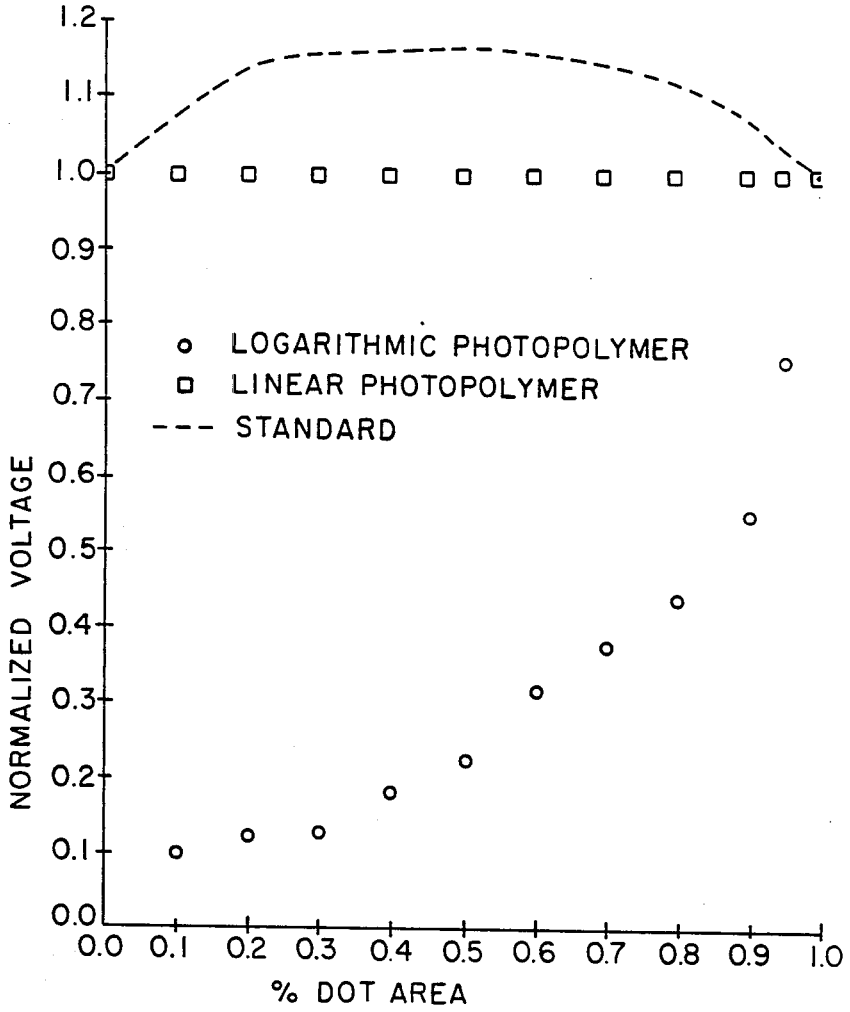
FIG. 1 illustrates the desired (standard) dot gain (dash curve) and the departure from it illustrated by linear (square curve) and logarithmic (circle curve) photopolymer compositions.

In accordance with this invention there is provided a high resolution, photohardenable electrostatic master comprising an electrically conductive substrate bearing a layer of a photohardenable composition consisting essentially of (a) an organic polymeric binder, (b) a compound having at least one ethylenically unsaturated group, (c) a photoinitiator, and (d) at least 0.1% by weight based on the total weight of the photohardenable composition of at least one organic electron acceptor compound or at least one organic electron donor compound.

DETAILED DESCRIPTION OF THE INVENTION

The photohardenable (photopolymerizable) layer of the electrostatic master consists essentially of an organic polymeric binder, a compound having at least one ethylenically unsaturated group which can be a monomer, a photoinitiator and at least one organic electron donor, also known as a p-type conducting compound, or at least one organic electron acceptor, also known as an n-type conducting compound. Preferably a chain transfer agent is also present. Other ingredients can also be present as set out below. Polymeric binders, ethylenically unsaturated compounds, photoinitiators, including preferred hexaarylbiimidazole compounds (HABI's) and chain transfer agents are disclosed in Chambers U.S. Pat. No. 3,479,185, Baum et al. U.S. Pat. No. 3,652,275, Cescon U.S. Pat. No. 3,784,557, Dueber U.S. Pat. No. 4,162,162, and Dessauer U.S. Pat. No. 4,252,887, the disclosures of each of which are incorporated herein by reference.

Accordingly, to the photohardenable composition is added an electron donor (p-type) compound, which provides sites for a hole-like hopping transport of charge, or an electron acceptor (n-type) compound, which provides sites for an electron-like hopping transport of charge. The electron donor (p-type) compound is preferred for use with a negatively charged liquid electrostatic developer and the electron acceptor (n-type) compound for positively charged liquid electrostatic developer. While not being limited to any particular theory, experiments seem to indicate that when a p-type doped photopolymer is used in combination with a negatively charged developer, backtransfer or reverse transfser of developer from the paper onto the electrostatic master is largely reduced. The hopping type transport introduced by the electron donor or acceptor molecules complements the ionic conductivity due to the presece of ionizable species, such as residual acids or their salts. Experimental results indicate that the origin of the ionizable species is largely due to impurities in the monomer.

Useful electron donors and electron acceptors have an oxidation potential of less than +2.5 eV or a reduction potential larger than −3.0 eV, respectively. Particular classes of suitable such electron donor and electron acceptors include compounds selected from the group consisting of

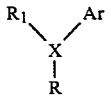

(1)

wherein R is alkyl or substituted alkyl of 1 to 12 carbon atoms, preferably 1 to 6 carbon atoms, aryl of 6 to 10 carbon atoms, aryl of 6 to 10 carbon atoms substituted with alkyl of 1 to 12 carbon atoms, preferably 1 to 6 carbon atoms, $NO_2$, halogen, e.g., Cl, Br, I, F; or alkoxy of 1 to 12 carbon atoms; $R_1$ is H, alkyl of 1 to 12 carbon atoms, preferably 1 to 6 carbon atoms, aryl of 6 to 10 carbon atoms, aryl of 6 to 10 carbon atoms substituted with alkyl of 1 to 12 carbon atoms, preferably 1 to 6 carbon atoms, $NO_2$, halogen, e.g., Cl, Br, I, F; or alkoxy of 1 to 12 carbon atoms; Ar is aryl of 6 to 10 carbon atoms, aryl of 6 to 10 carbon atoms substituted with alkyl of 1 to 12, $NO_2$, halogen, e.g., Cl, Br, I; F; alkoxy of 1 to 12 carbon atoms, and Ar can be connected to $R_1$ by a bond when $R_1$ is aryl or substituted aryl as set out above; X is an element from Group 5 of the Periodic Table; X-R can be carbonyl; and (2) a polycyclic or substituted polycyclic aromatic compound.

Some specific illustrations of useful electron donors and electron acceptors with their oxidation and reduction potentials expressed in eV include:

| | |
|---|---|
| triphenyl amine | 1.00 |
| triphenyl phosphine | 0.82 |
| triphenyl arsenic | 0.66 |

-continued

| | |
|---|---|
| triphenyl antimony | 0.45 |
| naphthalene | 1.60 or −2.29 |
| 9-ethyl carbazole | 1.25 |
| methyl diphenylamine | 0.84 |
| dimethyl aniline | 0.78 |
| benzophenone | −1.68 |
| trinitrofluorenone | −0.45 |
| biphenyl | −1.65 |
| diphenyl amine | 0.78 |

Additional electron donors and acceptors with their oxidation and reduction potentials are set out in Israel Journal of Chemistry, Vol. 8, 263 (1979).

Binders

Suitable binders include: the polymerized methylmethacrylate resins including copolymers thereof, polyvinyl acetals such as polyvinyl butyral and polyvinyl formal, vinylidene chloride copolymers (e.g., vinylidene chloride/acrylontrile, vinylidene chloride/methacrylate and vinylidene chloride/vinyl-acetate copolymers), synthetic rubbers (e.g., butadiene/acrylonitrile copolymers and chloro-2-butadiene-1,3-polymers), cellulose esters (e.g., cellulose acetate, cellulose acetate succinate and cellulose acetate butyrate), polyvinyl esters (e.g., polyvinyl acetate/acrylate, polyvinyl acetate/-metharcylate and polyvinyl acetate), polyvinyl chloride and copolymers, (e.g., polyvinyl chloride/acetate), polyurethanes, polystyrene. Preferred binders are poly(styrene/methylmethacrylate) and polymethylmethacrylate.

The resistivity of the binder largely contributes to the total resistivity of the photohardenable composition in both exposed and unexposed areas. However, it is the resistivity of the photopolymer matrix or total composition that controls image characteristics and dot gain. If the total resistivity of the unexposed composition is too small, the charge will decay too rapidly in the unexposed areas losing the highlight dots. On the other hand, if the resistivity of the photopolymer composition is too high the discharge rate may be too slow, resulting in overtoning solids and overfilling of large dots. The preferred resistivity of the exposed photopolymer composition, for the present application, is about $10^{14}$ to $10^{16}$ Ω-cm, corresponding to a binder resistivity in the $10^{16}$ to $10^{20}$ Ω-cm range. For different applications a different resistivity for the binder may be desired, but the ratio between the conductivities of the polymerized and unpolymerized areas can still be controlled for optimal values by the invention. Ethylenically Unsaturated Compounds Any ethylenically unsaturated photopolymerizable or photocrosslinkable compound identified in the prior patents for use in HABI-initiated systems can be used. The term "monomer" as used herein includes simple monomers as well as polymers, usually of molecular weight below 1500, having crosslinkable ethylenic groups. Preferred monomers are di-, tri-and tetra-acrylates and -methacrylates such as ethylene glycol diacrylate, diethylene glycol diacrylate, triethylene glycol diacrylate, glycerol diacrylate, glycerol triacrylate, ethylene glycol dimethacrylate, 1,2-propanediol dimethacrylate, 1,2,4-butanetriol trimethacrylate, 1,4-cyclohexanediol diacrylate, 1,4-benzenediol dimethacrylate, pentaerythritol tetramethacrylate, 1,3-propanediol diacrylate, 1,5-pentanediol dimethacrylate, pentaerythritol triacrylate; the bisacrylates and methacrylate, of polyethylene glycols of molecular weight 100–500, etc. A particularly preferred monomer is ethoxylated trimethylolpropane triacrylate.

The impurities in the monomer can be the major source of charge carriers. Therefore, the overall discharge rate of a photohardenable composition is largely determined by the concentration of ionizable impurities in the monomer. Monomers that generally are used have resistivities in the range $10^5$ to $10^9$ Ω-cm resulting in photohardenable compositions with a resistivity of $10^{11}$ to $10^{13}$ Ω-cm for unexposed regions. It should be understood, however, that prior to this invention the electrical properties of an electrostatic master were given by an undetermined number of unknown impurities. Since it is essential to control the conductivity of the photohardenable composition, we introduced into the composition a known quantity of electron donors or acceptors. It is these molecules, and not the monomer impurities, that are used to control the discharge characteristic of the photohardenable composition in the exposed areas.

Initiators

Preferred initiators are the HABI photoinitiators, 2,2',4,4',5,5'-hexaarylbiimidazoles, sometimes called 2,4,5-triarylimidazolyl dimers, which dissociate on exposure to actinic radiation to form the corresponding triarylimidazolyl free radicals. As indicated above, HABI's and use of HABI-initiated photopolymerizable systems for applications other than for electrostatic uses are disclosed in a number of patents. These include: Ceson U.S. Pat. No. 3,784,557; Chambers U.S. Pat. No. 3,479,185; Chang et al. U.S. Pat. No. 3,549,367; Baum et al. U.S. Pat. No. 3,652,275; Dueber U.S. Pat. No. 4,162,162; Dessauer U.S. Pat. No. 4,252,887; Chambers et al. U.S. Pat. No. 4,264,708; and Tanaka et al., U.S. Pat. No. 4,459,349; the disclosures of these patents are incorporated herein by reference. Any 2-o-substituted HABI disclosed in the prior patents can be used in this invention. The HABI's can be represented by the general formula

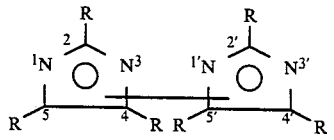

where the R's represent aryl radicals. The 2-o-substituted HABI's are those in which the aryl radicals at positions 2 and 2' are ortho-substituted. The other positions on the aryl radicals can be unsubstituted or carry any substituent which does not interfere with the dissociation of the HABI upon exposure or adversely affect the electrical or other characteristics of the photopolymer system.

Preferred HABI's are 2-o-chlorosubstituted hexaphenylbiimidazoles in which the other positions on the phenyl radicals are unsubstituted or substituted with chloro, methyl or methoxy. The most preferred HABI's are 2,2',4,4'-tetrakis(o-chloro-phenyl)-5,5'-bis(m,p-dimethoxyphenyl)-biimidazole and 2,2'-bis(o-chlorophenyl)-4,4',5,5'-tetraphenylbiimidazole.

Processes for producing HABI compounds result in a mixture of isomers and other impurities. Use of high concentrations of these impure materials can provide photopolymerizable compositions with high sensitivity but poor shelflife or storage stability due to crystallization. It has been found that purification of the materials by various methods can provide relatively pure materials which can be used in high concentration without crystallization.

The HABI's can be purified sufficiently for use in this invention by merely dissolving them in methylene chloride, filtering and recrystallizing by adding methanol or ether. If desired, the solution of the HABI in methylene chloride can be eluted through a silica gel column prior to recrystallization. Preferred methods for purification of the preferred HABI's are as follows:

TCTM-HABI (1) Preferred method.

50 g of reddish brown TCTM-HABI (melting range (m.r.) 170°–215° C.) is added to 425 ml ethanol and 100 ml of distilled water. The slurry is stirred for 5 to 10 min. and allowed to settle for 30 min. Most of the supernatant red liquid is removed. 200 ml of dis- tilled water is added and the fresh slurry is stirred 5 to 10 min. and filtered through #54 (fast) paper. The collected solid is dried at 120° C. for 3 to 5 hours. The yield of white solid is 44 g (88%) and with m.r. 170° to 220° C.

(2) Alternate method 50 g of reddish brown TCTM-HABI is added to 250 ml ethanol and 200 ml of water. After stirring the slurry for 10 minutes it is allowed to settle for 10 minutes prior to filtration through #5 (slow) paper. The solid is collected and after drying yields a while powder with similar yield and m.r. as above.

o-Cl-HABI 225 g of o-Cl-HABI (m.r. 205°–7° C.) is added to 1800 ml methylene chloride and solution heated to the boil. 150 g DARCO ® G-60 charcoal activated made by EM Science, a Division of EM Industries, Inc., Cherry Hill, NH is then added. Mixture is kept boiling for 30 to 45 min. prior to hot filtration through Celite ® Diatomaceous silica product, Manville Products Corp., Denver, CO under vacuum. Filtrate is concentrated to yield ca. 135 g (60%) solid with m.r. 203°–5° C. Filter pad is washed with 200 ml of methylene chloride and filtrate concentrated to yield ca. 45 g (20%) solid with m.r. 203°–207° C.

Additional photoinitiators that are also useful in the photohardenable composition include anthraquinone types, aromatic ketones, and benzoin ethers. Examples of such other photoinitiators are: anthraquinones, e.g., α-ethyl anthraquinone, 9,10-anthraquinone, 1-chloroanthraquinone, 2-chloroanthraquinone, 2-methylanthraquinone, 2-tert-butylanthraquinone, octamethylanthraquinone, 1,4-naphthaquinone, 9,10-phenanthrenequinone, 1,2-benzanthraquinone, 2,3-benzanthraquinone, 2-methyl-1,4-naphthaquinone, 2,3-dichloronaphthaquinone, 1,4-dimethylanthraquinone, 2,3-dimethylanthraquinone, 2-phenyl-anthraquinone, 2,3-diphenylanthraquinone, sodium salt of anthraquinone a-sulfonic acid, 3-chloro-2-methylanthraquinone, retenequinone, 7,8,9,10-tetrahydronaphthacenequinone, 1,2,3,4-tetrahydrobenz(a)anthracene-7,12-dione; aromatic ketones, e.g., benzophenone, Michler's ketone (4,4'-bis(dimethylamine)benzophenone), 4,4'-bis(diethylamino)-benzophenone, 4-acryloxy-4'-dimethylaminobenzophenone, 4-acryloxy-4'-diethylaminobenzophenone, 4-methoxy-4'-dimethylaminobenzophenone, phenanthrenequinone, 2,7-dit-butyphenanthrenequinone, etc.; benzoin ethers, e.g., benzoin methyl ether, benzoin ethyl ether and benzoin phenyl ether, methylbenzoin benzoin, ethylbenzoin, etc.

Electron Donor/Electron Acceptor

The presence in the photohardenable layer of at least one electron donor (p-type conductor) which provides sites for a hole-like hopping transport of charge, or an electron acceptor (n-type conductor) which is believed to provide sites for an electron-like hopping transport of charge, thus makes it possible to modify in a controlled manner the transport properties for electrostatic images. Prior to this invention the photopolymer conductivity was due to the ionizable impurities in the monomer. These unknown number of impurities appeared to be residual acid groups and salt-like structures. In contrast, our invention permits precise control and reproducibility of the discharge characteristic of the photohardenable composition. Backtransfer, the reverse transfer of toner from the paper onto the electrostatic master during subsequent image transfer, is dramatically reduced by including into the photohardenable composition an electron acceptor molecule, if using negatively charged electrostatic developers, and an electron donor molecule when using positively charged electrostatic developers.

Specific electron donor compounds which must be different type compounds from the initiators described above include: aromatic amines, e.g., triphenyl amine, diphenyl amine, methyl diphenyl amine, N,N-dimethyl aniline, N,N-diethyl aniline, diethyl amine, triethyl amine, 1,4-diazabicyclo[2.2.2]octane, N,N,N,N'-tetramethylbenzidine; arsenic, antomony, bismuth, phosphorous, and cyanide compounds, e.g., triphenyl arsine, triphenyl antimony, triphenyl bismuth, triphenyl phosphine, dimethylcyanamide, etc.; carbazole compounds, e.g., 9-ethyl carbazole, polyvinylcarbazole; olefins and cyclic aromatic compounds, e.g., naphthalene, cyanonaphthalene, 1,4-di-cyanonaphthalene, 1,1-diphenylethylene, indene, norbornadiene, quadricyclene; methoxy compounds, e.g., 2-methoxynaphthalene, 1,3,5-trimethoxybenzene, o-dimethoxybenzene, 3-methoxypyrene, 3,4-dimethoxy-N,N-dimethylaniline, 2,4-dimethoxy-N,N-dimethylaniline, 1,2-dimethoxy benzene; nitro compounds, e.g., nitrobenzene, p-dinitrobenzene; quinones, e.g., benzoquinone, electron acceptors, e.g., trinitrofluoreneone, p-biphenyl, pyridine, benzonitrile, di-cyanobenzene, pyrene-3-carboxylic acid, benzacridine, anthracene, benzanthracene, pyrene-4-carboxylic acid, 4-azaphenanthrene, benzophenone, acetophenone, 2,6,9,10-tetracyanoanthracene, 4-methylbenzoate, etc.

The oxidation/reduction potentials of many of these compounds can be found in the technical reference set out above.

Triphenylamine is the preferred electron donor; biphenyl is the preferred electron acceptor.

Chain Transfer Agent

Many chain transfer agent (CTA) identified in the prior patents for use with HABI-initiated photopolymerizable systems can be used. For example, Baum et al. U.S. Pat. No. 3,652,275 lists N-phenylglycine, 1,1-dimethyl-3,5-diketocyclohexane, and organic thiols such as 2-mercaptobenzothiazole, 2-mercaptobenzoxazole, 2-mercaptobenzimidazole, pentaerythritol tetrakis (mercaptoacetate), 4-acetamidothiophenol, mercaptosuccinic acid, dodecanethiol, and beta-mercaptoethanol. Others which can be used include various tertiary amines known in the art, 2-mercaptoethane sulfonic acid, 1-phenyl-4H-tetrazole-5-thiol, 6-mercaptopurine monohydrate, bis-(5-mercapto-1,3,4-thiodiazol-2-yl, 2-mercapto-5-nitrobenzimidazole, and 2-mercapto-4sulfo-6-chlorobenzoxazole. The preferred CTA's are 2-mercaptobenzoxazole (2-MBO) and 2-mercaptobenzothiazole (2-MBT). Especially preferred are 2-MBO and 2-MBT purified as illustrated below for 2-MBO:

2-MBO: Optimum Melting Point 193°–194° C.

(1) For slightly impure lots (m.r.: 191°–193° C.) the following procedure is employed:

A slurry of 300 g 2-MBO in 1500 ml methanol is stirred for 5 to 10 minutes and allowed to settle. Generally, the solvent layer assumes a red appearance due to impurities. The undissolved solid is filtered through #5 filter paper in a Buchner funnel with house vacuum. Solid is washed with cold methanol (1 100 ml portion), collected and dried in oven at 70°–80° C. for 3 to 5 hours, subsequently pulverized and dried for an additional hour, Yield is approximately 150 g (50%) of white powder, m.r. 193°–94° C.

(2) For impure lots (m.p. below 191° C.) the following procedure is used:

250 g brown 2-MBO, 50 g DARCO ® G-60 charcoal activated, 1500 ml methylene chloride and 600 ml methanol are stirred in a 4 liter Erlenmeyer flask with gentle boiling for 30 to 40 minutes. The mixture is filtered hot through fast (#4) paper under low vacuum. The red liquor that is collected is concentrated under low vacuum until 2-MBO precipitates out of solution. 200 ml of fresh methanol is added, and the resulting slurry is agitated to break up large lumps. The slurry is filtered through slow (#5) paper and washed with 50 ml fresh methanol. The colorless pre- cipitate is collected and dried at 70 to 80 degrees for 3 to 5 hours as above. Yield of product, melting above 192° C. is ca. 50%.

Additives

In addition to the primary ingredients and chain transfer agent, the photohardenable compositions can contain conventional ingredients such as co-initiators, thermal stabilizers, plasticizers, brighteners, energy transfer dyes (i.e., visible light sensitizers), UV absorbers, photoinhibitors, etc. The preferred thermal stabilizers is 1,4,4-trimethyl-2,3-diazobicyclo(3.2.2)-non-2-ene-N,N-dioxide (TAOBN). Leuco dyes can also be present, e.g., Leuco Malachite Green, Leuco Crystal Violet, and leuco dyes disclosed by Baum et al., U.S. Pat. No. 3,652,275, Col. 7, line 40 to column 11, line 31, the disclosure of which is incorporated herein by reference. Visible light sensitizers and photoinhibitors are disclosed in Dueber, U.S. Pat. No. 4,162,162 and Pazos, U.S. Pat. No. 4,198,242, respectively, the disclosures of which are incorporated herein by reference.

In general, the essential components should be used in the following approximate proportions: binder 40–75 percent, preferably 50–65 percent; monomer 15–40 percent; preferably 25–35; initiator 1–20 percent, preferably 1–10 percent; and preferably a chain transfer agent 0–5 percent, preferably 0.1–4 percent. The amount of electron acceptor or donor present in the photohardenable composition depends on the particular donor or acceptor compound. The electron donor or acceptor is present in at least about 0.1% by weight. For example, triphenyl amine (TPA) is present in the range of 1–15%, preferably 3–7%; triphenyl phosphine (TPP) is present in the range of 1–5% and when used in combination with other electron donors is present in an amount of at least 0.15% TPP in combination with at least 3% of the other donor; diphenyl amine (DPA) is present in the range of 0.1–2%, preferably 0.25–0.75%. These are weight percentages based on total weight of the photopolymerizable system. The preferred proportions depend upon the particular compounds selected for each component of the photopolymerizable composition. For example, a high conductivity monomer can be used in smaller amount than a low conductivity monomer, since the former will be more efficient in eliminating charge from unexposed areas.

The amount of photoinitiator such as HABI and charge transfer agent, e.g., 2-MBO, etc. incorporated in the photohardenable layer will depend upon film speed requirement. Higher speed systems can be used with laser imaging in recording digitized information, as in digital color proofing. For analog applications, e.g., exposure through a negative, film speed requirement depends upon mode of exposure. If the exposure device is a flat-bed type, where the negative is placed over the photopolymer matrix, exposures of up to 30 seconds can be used and a photographically slow film will be acceptable. For a drum exposure device, with a collimated source of radiation, the exposure per pixel may be brief and a higher speed film may be more useful.

The photohardenable layer is prepared by mixing the ingredients of the photopolymerized system in a solvent such as methylene chloride, usually in a weight ratio of about 15:85 to 25:75, coating a substrate, and evaporating the coating. Coating thickness should be uniform and about 3 to 15 μm, preferably 7 to 12 μm dry. Dry coating weight should be about 30 to 180 mg/dm$^2$, preferably 70 to 120 mg/dm$^2$.

The conductive support may be a metal plate, such as aluminum, copper, zinc, silver or the like; a conductive polymeric film; a support such as paper, glass, synthetic resin and the like which has been coated on one or both sides with a metal, conductive metal oxide, or metal halide by vapor deposition or sputtering chemical deposition; a support which has been coated with a conductive polymer; or a support which has been coated with a polymeric binder containing a metal, conductive metal oxide, metal halide, conductive polymer, carbon, or other conductive fillers.

Exposure/Charging/Toning/Transfer

Exposing radiation can be modulated by either digital or analog means. Analog exposure utilizes a line or half-tone negative or other pattern interposed between radiation source and film. For analog exposure, UV light source is preferred, since the photopolymerizable system is most sensitive to shorter wavelength light. Digitial exposure is by means of a computer controlled visible light-emitting laser which scans the film in raster fashion. For digital exposure a high speed film, i.e., one containing a high-level of HABI, chain transfer agent and sensitized to higher wavelength light with a sensitizing dye, should be used. Exposure must be sufficient to cause substantial polymerization in exposed areas and provide the required differential in conductivity between exposed and unexposed areas. Electron beam exposure can be used, but is not required, and is not preferred because of the expensive equipment required.

The preferred charging means is corona discharge. Other charging methods, e.g., discharge of a capacitor, can also be used.

Any electrostatic liquid developer and any method of developer application can be used. Preferred liquid electrostatic developers are suspensions of pigmented resin toner particles in nonpolar liquids which are charged with ionic or zwitterionic comounds. The nonpolar liquids normally used are the Isopar® branched-chain aliphatic hydrocarbons (sold by Exxon Corporation) which have a Kauri-butanol value of less than 30 and optionally containing various adjuvants are described in Mitchell U.S. Pat. Nos. 4,631,244 and 4,663,264, Taggi U.S. Pat. No. 4,670,370 and assignee's following U.S. patent applications Ser. Nos. 804,385, filed Dec. 4, 1985, 854,610 filed Apr. 22, 1986, 856,392 filed Apr. 28, 1986, 857,326 and 857,349, both filed Apr. 30, 1986, and 880,155 filed June 30, 1986. These are narrow high-purity cuts of isoparaffinic hydrocarbon fractions with the following boiling ranges: Isopar®-G, 157°–176° C.; Isopar®-H 176°–191° C.; Isopar®-K 177°–197° C.; Isopar®-L 188°–206° C.; Isopar®-M 207°–254° C.; Isopar®-V 254°–329° C. Preferred resins having an average particle size of less than 10 μm are copolymers of ethylene (80 to 99.9%)/acrylic or methacrylic acid (20 to 0%)/alkyl of acrylic or methacylic acid where alkyl is 1 to 5 carbon atoms (0 to 20%), e.g., copolymers of ethylene (89%) and methacrylic acid (11%) having a metl index at 190° C. of 100. Preferred nonpolar liquid soluble ionic or zwitterionic components are lecithin and Basic Barium Petronate® oil-soluble petroleum sulfonate. Many of the monomers useful in the photohardenable composition are soluble in these Isopar® hydrocarbons, especially in Isopar®-L. Consequently, repeated toning with Isopar® based toners to make multiple copies can deteriorate the electrical properties of the master by extraction of monomer from unexposed areas. The preferred monomers are relatively insoluble in Isopar® hydrocarbons, and extended contact with these liquids does not unduly deteriorate films made with these monomers. Photohardenable electrostatic masters made with other, more soluble monomers can still be used to make multiple copies, using liquid toner having a dispersant with less solvent action.

After developing the toner image is transferred to another surface, such as paper for the preparation of a proof. Other substrates are polymeric film, or cloth. For making intergrated circuit boards, the transfer surface can be an insulating board on which conductive circuit lines can be printed by this process, or it can be an insulating board covered with a conductor (e.g., a fiber glass board covered with a copper layer) on which a resist is printed by this process. Transfer is accomplished by electrostatic or other means, e.g., by contact with an adhesive receptor surface or applying pressure and heat. Electrostatic transfer can be accomplished in any known manner, e.g., by placing the paper in contact with the toned image using a tackdown roll or corona when held at negative voltages will press the two surfaces together assuring intimate contact. After tackdown, one applies a positive corona discharge to the backside of paper driving the toner particles off the electrostatic master onto the paper. It is preferred to transfer the image without a master-paper gap greater than about 6 μm.

INDUSTRIAL APPLICABILITY

The photohardenable electrostatic master is particularly useful in the graphic arts field, particularly in the area of color proofing wherein the proofs prepared duplicate the images achieved by printing. This is accomplished by being able to control the desired gain of the halftone dots reproduced through control of the electrical conductivity of the exposed and unexposed areas of the photohardenable electrostatic master. The voltage retained by the halftone dots is almost linearly related to the percent dot area. Therefore, the thickness of the liquid electrostatic developer will be constant everywhere on the image independent of the particular dot pattern to be developed. Other uses for the photohardenable master include preparation of printed circuit boards, resists, soldermask, photohardenable coatings, etc.

EXAMPLES

The following examples illustrate but do not limit the invention wherein the percentages and parts are by weight. % Dot gain listed in the tables below is the value obtained for a 50% dot. In the examples, ingredient designations have the following meanings:

| | |
|---|---|
| | BINDERS |
| PMMA | Polymethylmethacrylate $\eta = 1.25$, where $\eta$ is the inherent viscosity $T_g = 95°$ C., where $T_g$ is the glass transition temperature |
| PSMMA | Poly(styrene/methylmethacrylate)(70/30) |
| | MONOMERS |
| TMPEOTA | ethoxylated trimethylol propane triacrylate |
| | INITIATORS |
| TCTM-HABI | 2,2',4,4'-tetrakis(o-chlorophenyl)-5,5'-bis(m,p-dimethoxyphenyl)-biimidazole (recrystallized from methanol/methylene chloride) |
| oCL-HABI | 2,2'-bis(o-chlorophenyl)-4,4'-5,5'-tetraphenylbiimidazole |
| CDM-HABI | 2,2'-bis(o-chlorophenyl)-4,4'-5,5'-tetrakis(m-methoxyphenyl)-biimidazole |
| 2-EAQ | ethyl anthraquinone |
| BME | benzoin methyl ether |
| | CHAIN TRANSFER AGENTS |
| 2-MBO | 2-mercaptobenzoxazole, recrystallized from methanol/methylene chloride |
| 2-MBI | 2-mercaptobenzimidazole |
| | ELECTRON ACCEPTOR (EA)/ELECTRON DONOR (ED) |
| TPA | triphenyl amine |
| TPP | triphenyl Phosphine |
| TPSb | triphenyl antimony |
| 9-EK | 9-ethyl carbazole |
| Bph | biphenyl |
| MDA | methyl diphenyl amine |
| DMA | dimethyl aniline |
| Nph | naphthalene |
| Bz | benzophenone |
| TNF | trinitroflourenone |

Except as indicated otherwise, the procedure in all examples was as follows:

A solution containing 86.5 parts of methylene chloride and 13.5 parts of solids (indicated ingredients: binder, monomer, initiator, chain transfer agent, electron acceptor or electron donor) was coated onto 0.004 inch (0.0102 cm) aluminized polyethylene terephthalate support and a 0.075 inch (0.019 cm) polypropylene cover sheet was laminated to the dried layer. The coating weights varied from 70 to 120 mg/dm$^2$ or about 7 $\mu$m to 12 $\mu$m in photopolymer layer thickness.

The photopolymer formulations were tested for electrical properties as well as for image quality. The discharge data is characterized by V° and $\tau$ where V°is the initial voltage retained at 0.01 second after charging by the unexposed photopolymer area and $\tau$ the transit time, i.e., the time interval required by the first injected carriers to travel across the photopolymer layer of the sample and reach the ground plane. The injected carriers are the charge species deposited by the corona on the photopolymer surface and the ionic impurities that are now mobile under the pressure of the large corona electric field.

The electrostatic data was obtained as follows: five 1 inch by 0.5 inch (2.54 cm by 1.27 cm) samples were mounted on a flat aluminum plate that was positioned on a friction free translational stage connected to a solenoid. The five samples were moved from position A to B, 1 inch (2.54 cm) apart, by activating the solenoid. In position A, they were placed directly under a scorotron for charging. The standard charging conditions were 100–200 V grid voltage ($V_g$), 50–200 $\mu$A corona current (4.35 to 5.11 kV) and 2 seconds charging time. After the charging was completed, the solenoid was energized and the samples were moved to B away from the scorotron where each sample was directly under Isoprobe electrostatic multimeters, Model #174, manufactured by Monroe Electronics Incorporated, Lyndonville, NY. The outputs of the electrostatic multimeters were then fed into a Hewlett Packard computer (Model #9836 manufactured by Hewlett Packard, Palo Alto, CA) through a data acquisition box (Model #3852A also manufactured by Hewlett Packard) where the voltage versus time was recorded for each sample.

In order to test the image quality of each photpolymer composition, the photopolymer layer was exposed, charged, toned and the image transferred onto paper as described below. The evaluation of image quality was based on dot gain and dot range on paper. The standard paper is 60 lbs Solitaire® paper, offset enamel text, Plainwell Paper Co., Plainwell, MI. However, the variety of papers tested included: 60 lbs Plainwell offset enamel text, 70 lbs Plainwell offset enamel text, 150 lbs white Regel Tufwite® Wet Strength Tag, 60 lbs White LOE Gloss Cover, 70 lbs white Flokote® Text, 60 lbs white all purpose lith, 110 lbs white Scott Index, 70 lbs white Nekoosa Vellum Offset and 80 lbs white Sov® text. Results indicated that although the process can be used with any paper, the trapping of the ink varies with the fibrillar nature of the paper in use. Dot gain or dot growth versus dot size is a standard measure of how tolerances between a proof and a press proof are determined. The dot gains were tested using specially designed patterns called Brunner targets which are commerically available from System Brunner USA, Inc., Rye, NY. The dot range was easily tested using UGRA targets, Graphic Arts Technical Foundation, Pittsburgh, PA that include 0.5% highlight dots to 99.5% shadow dots in a 133 lines/mm screen as well as 4 $\mu$m highlights and shadow microlines.

The photohardenable electrostatic master was first exposed using a vacuum frame through the cover sheet, a UV light transmitting, visible light absorbing Kokoma® glass filter (No. 400, Kokomo Opalescent Glass Co., Kokomo, IN) and a separation negative using a Douthitt Option X exposure unit (Douthitt Corporation, Detroit, MI), equipped with a model TU 64 Violux ®5002 lamp assembly (Exposure Systems Corporation, Bridgeport, CT) and a model No. 5027 photopolymer type lamp. Exposure times varies from 1 to 100 seconds depending on the photohardenable layer formulation. Exposure times were largely dependent on the composition of the photohardenable layer. For example, the correct exposure for samples that included triphenyl amine was 2–4 seconds while a 90–120 seconds exposure as necessary for those compositions that included triphenyl phosphine. (The latter compound appears to act also as a polymerization inhibitor). The exposed master was then mounted on a drum surface. SWOP (Specification Web Offset Publications) density in the solid areas was obtained by charging the fully exposed regions of the photopolymer to 100 V to 200 V. The charged latent image was then developed with a liquid electrostatic developer described in Example 12 using a two roller toning station, and the developer layer properly metered. The developing and metering stations (removes excess developer) were placed at 5 and 6 o'clock position, respectively. The toned image was corona transferred onto paper using 50–150 μA transfer corona and 4.35 to 4.88 kV, and −2.5 to −4.0 kV tackdown roll voltage at a speed of 2.2 inches/sec (5.588 cm/sec) and fused in an oven for 10 seconds at 100° C.

The dot gain curve were determined using a programmable Macbeth densitometer, Model #RD918 (McBeth Process Measurements, Newburgh, NY) interfaced to an Hewlett Packard computer Model #9836. The dot gain curve is calculated by using a simple algorithm that includes the optical density of a solid patch, the optical density of the paper (gloss) and the optical density of each percent dot area in the Brunner target.

EXAMPLE 1

The photopolymerizable layer for the samples had the composition with the results indicated as shown in the tables below.

EXAMPLE 1

TABLE 1

| SAMPLE | INGREDIENTS (%) TMPEOTA | TCTM HABI | 2-MBO | TPSb | PMMA | V° | τ (sec) | % DOT RANGE | % DOT GAIN |
|---|---|---|---|---|---|---|---|---|---|
| 1 | 25 | 5 | 3 | 0 | 67 | 146 | 35 | — | — |
| 2 | 25 | 5 | 3 | 1 | 66 | 131 | 12 | — | — |
| 3 | 25 | 5 | 3 | 5 | 62 | 104 | 7 | 1–98 | 30 |
| 4 | 25 | 5 | 3 | 10 | 57 | 69 | 3 | 1–98 | 25 |
| 5 | 25 | 5 | 3 | 12.5 | 54.5 | 58 | 1 | 1–98 | 15 |
| 6 | 25 | 5 | 3 | 15 | 52 | 41 | 0.27 | 2–98 | 9 |

EXAMPLE 2

TABLE 2

| SAMPLE | INGREDIENTS (%) TMPEOTA | TCTM HABI | 2-MBO | 9-EK | PMMA | V° | τ (sec) | % DOT RANGE | % DOT GAIN |
|---|---|---|---|---|---|---|---|---|---|
| 1 | 25 | 5 | 3 | 0 | 67 | 140 | 30 | — | — |
| 2 | 25 | 5 | 3 | 1 | 66 | 125 | 15 | — | — |
| 3 | 25 | 5 | 3 | 5 | 62 | 100 | 7 | 1–98 | 26 |
| 4 | 25 | 5 | 3 | 10 | 57 | 52 | 1.5 | 0.5–95 | 24 |
| 5 | 25 | 5 | 3 | 12.5 | 54.5 | 45 | 0.9 | 2–98 | 16 |
| 6 | 25 | 5 | 3 | 15 | 52 | 38 | 0.4 | 2–98 | 7 |

EXAMPLE 3 (%)

TABLE 3

| SAMPLE | INGREDIENTS (%) TMPEOTA | TCTM HABI | 2-MBO | Bz | PMMA | V° | τ (sec) | % DOT RANGE | % DOT GAIN |
|---|---|---|---|---|---|---|---|---|---|
| 1 | 25 | 5 | 3 | 0 | 67 | 150 | 31 | — | — |
| 2 | 25 | 5 | 3 | 1 | 66 | 110 | 10.2 | — | — |
| 3 | 25 | 5 | 3 | 5 | 62 | 109 | 5 | 2–98 | 22 |
| 4 | 25 | 5 | 3 | 10 | 57 | 102 | 1.5 | 2–98 | 16 |
| 5 | 25 | 5 | 3 | 12.5 | 54.5 | | | | |
| 6 | 25 | 5 | 3 | 15 | 52 | 79 | 1.0 | 2–98 | 14 |
| 7 | 30 | 5 | 3 | 5 | 52 | 23 | 0.3 | 4–98 | 6 |

TABLE 4

| SAMPLE | INGREDIENTS (%) TMPEOTA | TCTM-HABI | 2-MBO | TPA | PMMA | PSMMA | V° | τ (sec) | % DOT RANGE | % DOT GAIN |
|---|---|---|---|---|---|---|---|---|---|---|
| 1 | 30 | 5 | 3 | 5 | 57 | | 150 | 0.8 | 0.5–99 | 16 |
| 2 | 30 | 1 | 3 | 5 | 61 | | 200 | 0.9 | 0.5–99 | 17 |
| 3 | 32 | 5 | 3 | 5 | 55 | | 7 | 0.16 | 0.5–98 | 8 |
| 4 | 35 | 1 | 3 | 5 | 56 | | 20 | 0.3 | 1–98 | 12 |
| 5 | 30.8 | 5.15 | 0.15 | 5.15 | 58.78 | | 70 | 1.8 | 1–95 | 20 |
| 6 | 30 | 1 | 0.1 | 6 | 62.9 | | 100 | 2.8 | 1–98 | 22 |
| 7 | 32 | 5 | 3 | 5 | | 55 | 31 | 0.4 | 4–98 | 5 |
| 8 | 30 | 1 | 3 | 7 | 59 | | 10 | 0.7 | 2–98 | 14 |
| 9 | 28.6 | 4.8 | 3.97 | 6.7 | 57 | | 24 | 0.75 | 1–98 | 17 |

TABLE 4-continued

| SAMPLE | INGREDIENTS (%) TMPEOTA | TCTM-HABI | 2-MBO | TPA | PMMA | PSMMA | V° | τ (sec) | % DOT RANGE | % DOT GAIN |
|---|---|---|---|---|---|---|---|---|---|---|
| 10 | 28 | 5 | 3 | 10 | 54 | | 85 | 2.1 | 1–99 | 19 |

EXAMPLE 5 (%)

TABLE 5

| SAMPLE | INGREDIENTS (%) TMPEOTA | TCTM HABI | 2-MBO | TPA | TPP | PMMA | V° | τ (sec) | % DOT RANGE | % DOT GAIN |
|---|---|---|---|---|---|---|---|---|---|---|
| 1 | 20 | 5 | 3 | 5 | 3 | 64 | 20 | 0.15 | 2–99 | 5 |
| 2 | 20 | 5 | 3 | 5 | 2 | 65 | 25 | 0.6 | 2–98 | 10 |
| 3 | 20 | 5 | 3 | 5 | 1 | 66 | 50 | 1.1 | 1–98 | 17 |
| 4 | 20 | 5 | 3 | | 5 | 67 | 58 | 0.95 | 0.5–98 | 16 |
| 5 | 20 | 5 | 4 | | 4 | 67 | 61 | 1.0 | 1–98 | 17 |
| 6 | 25 | 5 | 3 | 5 | 0.25 | 61.75 | 45 | 0.8 | 2–98 | 17 |
| 7 | 25 | 5 | 3 | 5 | 0.15 | 61.85 | 82 | 2.4 | 2–98 | 23 |
| 8 | 25 | 1 | 0.1 | 5 | 0.25 | 68.65 | 61 | 1.7 | 2–98 | 19 |

EXAMPLE (%)

TABLE 7

| SAMPLE | INGREDIENTS (%) TMPEOTA | TCTM HABI | 2-MBO | Nph | PMMA | V° | τ (sec) | % DOT RANGE | % DOT GAIN |
|---|---|---|---|---|---|---|---|---|---|
| 1 | 25 | 5 | 3 | 5 | 62 | 96 | 2.3 | 2–98 | 20 |
| 2 | 25 | 5 | 3 | 10 | 57 | 87 | 2.1 | 1–98 | 19 |
| 3 | 30 | 5 | 3 | 1 | 61 | 80 | 1.1 | 1–99 | 16 |
| 4 | 30 | 5 | 3 | 5 | 57 | 45 | 0.7 | 1–99 | 17 |
| 5 | 30 | 5 | 3 | 10 | 52 | 30 | 0.3 | 2–99 | 10 |

EXAMPLE 6

TABLE 6

| SAMPLE | INGREDIENTS (%) TMPEOTA | TCTM HABI | 2-MBO | TPA | MDPA | DMA | PMMA | V° | τ (sec) | % DOT RANGE | % DOT GAIN |
|---|---|---|---|---|---|---|---|---|---|---|---|
| 1 | 25.32 | 4.78 | 2.9 | 4.9 | 4.9 | | 57.2 | 102 | 2.6 | 1–98 | 25 |
| 2 | 21.2 | 5 | 2.6 | 10 | 5.1 | | 56.1 | 43 | 0.76 | 2–98 | 11 |
| 3 | 30 | 5 | 3 | 5 | | 10 | 47 | 22 | 0.4 | 3–98 | 4 |
| 4 | 30 | 5 | 3 | 5 | | 5 | 52 | 31 | 0.55 | 3–99 | 8 |
| 5 | 30 | 5 | 3 | 5 | | 2.5 | 54.5 | 54 | 9.95 | 1–98 | 15 |
| 6 | 25 | 5 | 3 | | | 10 | 57 | 42 | 0.6 | 3–98 | 9 |

EXAMPLE 8

TABLE 8

| SAMPLE | INGREDIENTS (%) TMPEOTA | TCTM HABI | 2-MBO | TPA | Nph | PMMA | V° | τ (sec) | % DOT RANGE | % DOT GAIN |
|---|---|---|---|---|---|---|---|---|---|---|
| 1 | 22 | 5 | 3 | 10 | 5 | 55 | 45 | 0.75 | 1–98 | 15 |
| 2 | 22 | 5 | 3 | 5 | 10 | 55 | 42 | 0.6 | 1–98 | 13 |
| 3 | 30 | 5 | 3 | 2.5 | 5 | 54.5 | 62 | 1.05 | 3–99 | 12 |
| 4 | 25 | 5 | 3 | 5 | 2.5 | 59.5 | 105 | 4.4 | 1–99 | 25 |
| 5 | 25 | 5 | 3 | 2.5 | 5 | 59.5 | 110 | 3.5 | 2–99 | 23 |
| 6 | 30 | 5 | 3 | 5 | 2.5 | 54.5 | 48 | 0.8 | 1–98 | 14 |

EXAMPLE 9 (%)

TABLE 9

| SAMPLE | INGREDIENTS (%) TMPEOTA | TCTM HABI | 2-MBO | Bph | PMMA | V° | τ (sec) | % DOT RANGE | % DOT GAIN |
|---|---|---|---|---|---|---|---|---|---|
| 1 | 25 | 5 | 3 | 1 | 66 | 105 | 10 | 1–96 | 22 |
| 2 | 25 | 5 | 3 | 5 | 62 | 100 | 7 | 2–96 | 24 |
| 3 | 30 | 5 | 3 | 1 | 61 | 70 | 1.3 | 2–98 | 15 |
| 4 | 30 | 5 | 3 | 5 | 57 | 40 | 0.9 | 2–98 | 13 |
| 5 | 30 | 5 | 3 | 10 | 52 | 19 | 0.25 | 2–98 | 8 |

TABLE 10

| SAMPLE | TMPEOTA | TCTM-HABI | CDM-HABI | oCL-HABI | 2-EAQ | BME | 2-MBO | 2-MBI | TPA | PMMA | V° | τ (sec) | % DOT RANGE | % DOT GAIN |
|---|---|---|---|---|---|---|---|---|---|---|---|---|---|---|
| | INGREDIENTS (%) | | | | | | | | | | | | | |
| 1 | 28 | | | | 5 | | 3 | | 5 | 59 | 45 | 0.8 | 2–98 | 16 |
| 2 | 27 | | | | 10 | | 3 | | 5 | 55 | 37 | 0.8 | 2–98 | 15 |
| 3 | 30 | | | | | 5 | 3 | | 5 | 57 | 22 | 0.7 | 2–98 | 14 |
| 4 | 27 | | | | | 10 | 3 | | 5 | 55 | 12 | 0.5 | 3–99 | 7 |
| 5 | 30 | 5 | | | | | | 3 | 5 | 57 | 73 | 2.1 | 0.5–98 | 20 |
| 6 | 30 | 5 | | | | | | 1 | 5 | 59 | 81 | 2.5 | 0.5–98 | 23 |
| 7 | 30 | | 5 | | | | 3 | | 5 | 57 | 32 | 0.6 | 3–99 | 10 |
| 8 | 31 | | 2 | | | | 3 | | 5 | 59 | 46 | 0.7 | 2–98 | 12 |
| 9 | 30 | | | 5 | | | 3 | | 5 | 57 | 21 | 0.5 | 3–98 | 9 |
| 10 | 31 | | | 2 | | | 3 | | 5 | 59 | 28 | 0.6 | 2–98 | 10 |

EXAMPLE 11 (%)

TABLE 11

| SAMPLE | TMPEOTA | TCTM HABI | 2-MBO | TNF | PMMA | V° | τ (sec) | % DOT RANGE | % DOT GAIN |
|---|---|---|---|---|---|---|---|---|---|
| | INGREDIENTS (%) | | | | | | | | |
| 1 | 30 | 5 | 3 | 5 | 57 | 45 | 1.05 | 1–99 | 18 |
| 2 | 30 | 5 | 3 | 10 | 52 | 42 | 0.8 | 1–99 | 16 |
| 3 | 25 | 5 | 3 | 5 | 62 | 72 | 3.1 | 0.5–97 | 22 |
| 4 | 25 | 5 | 3 | 10 | 57 | 97 | 6.2 | — | — |

EXAMPLE 12

A photopolymerizable composition was prepared containing the following ingredients.

| INGREDIENTS | AMOUNT (g) |
|---|---|
| PMMA | 38,475 |
| TMPEOTA | 20,250 |
| TCTM-HABI | 3,376 |
| 2-MBO | 2,580 |
| TPA | 3,376 |
| Methylene chloride | 157,538 |

The solution was stirred for 24 hours to properly dissolve all components. It was coated on aluminized polyethylene terephthalate at 150 feet/minute (45.7 M/minute) coating speed. Coating weight was about 100 mg/dm$^2$. A polypropylene cover sheet was placed on the photopolymer surface immediately after drying. The photopolymer master formed was cut into four 20 inches by 30 inches (50.8 by 76.2 cm) elements and tested for its 4-color proofing characteristics.

A four color proof is obtained by following the steps described below. First, complementary registration marks are cut into the photopolymerizable layers of the masters prior to exposure. Four color separation negatives are prepared by exposing four photopolymerizable masters to the four color separation negatives corresponding to cyan, yellow, magenta and black colors. Each of the four photpolymerizable master negative, is exposed for 3 seconds using a Douthitt Option X exposure unit described above. The visible radiation emitted by this source is suppressed by a Kokomo ® glass filter also as described above and the total emitted intensity is reduced by 75% with the use of a 25% transmission screen. The cover sheets are removed and each master is mounted on a corresponding color module drum, in a position assuring image registration of the four images as they are sequentially transferred from each master to the receiving paper. The leading edge clamps are also used to ground the photopolymer aluminized backplane to the drum. The masters are stretched by spring loading the trailing edge assuring that each lays flat against its drum.

Each module has a charging scorotron at 3 o'clock position, a developing station at 6 o'clock, a metering station at 7 o'clock and a cleaning station at 9 o'clock. The charging, toning and metering procedure is similar to that described above prior to the examples. The transfer station consists of a tackdown roll, a transfer corona, a paper loading, and a positioning device that fixes the relative position of paper and master in all four transfer operations.

In the preparation of the four-color proof, the four developers have the following composition.

| INGREDIENTS | AMOUNT (g) |
|---|---|
| BLACK | |
| Copolymer of ethylene (89%) and methacrylic acid (11%), melt index at 190° C. is 100, Acid No. is 66 | 2,193.04 |
| Sterling NF carbon black | 527.44 |
| Heucophthal Blue, G XBT-583D Heubach. Inc., Newark. NJ | 27.76 |
| Basic Barium Petronate ® | 97.16 |
| Aluminum tristearate, Witco 132 | 27.76 |
| Isopar ®-L, non-Polar liquid having a Kauri-Butanol value of 27, Exxon Corporation | 13,047.0 |
| CYAN | |
| Copolymer of ethylene (89%) and methacrylic acid (11%), melt index at 190° C. is 100, Acid No. is 66 | 3,444.5 |
| Ciba-Geigy Monarch Blue X3627 | 616.75 |
| Dalamar ® Yellow YT-858D Heubach, Inc., Newark. NJ | 6.225 |
| Aluminum tristearate. Witco 132 | 83.0 |
| Basic Barium Petronate ® | 311.25 |
| Isopar ®-L, non-polar liquid having a Kauri butanol value of 27, Exxon Corporation | 16,600.0 |
| MAGENTA | |
| Copolymer of ethylene (89%) and methacrylic acid (11%), melt index at 190° C. is 100, Acid No. is 66 | 4,380.51 |
| Mobay RV-6700, Mobay Chemical Corp., Haledon, NJ | 750.08 |
| Mobay RV-6713, Mobay Chemical Corp., Haledon, NJ | 750.08 |
| Aluminum tristearate, Witco 132 | 120.014 |
| Triisopropanol amine | 75.008 |
| Basic Barium Petronate ® | 720.08 |

-continued

| INGREDIENTS | AMOUNT (g) |
|---|---|
| Isopar ®-L, non-polar liquid having a Kauri-butanol value of 27, Exxon Corporation | 32,540.0 |
| YELLOW | |
| Copolymer of ethylene (89%) and methacrylic acid (11%), melt index at 190° C. is 100, Acid No. is 66 | 1,824.75 |
| Yellow 14 Polyethylene flush Sun Chemical Co. | 508.32 |
| Aluminum tristearate, Witco 132 | 46.88 |
| Basic Barium Petronate ® | 59.5 |
| Isopar ®-L, non-polar liquid having a Kauri-butanol value of 27, Exxon Corporation | 11,570.0 |

First, the yellow master is charged, developed and metered. The transfer station is positioned and the toned yellow image transferred onto the paper. After the yellow transfer is completed, the magenta master is corona charged, developed, metered, and the magenta image transferred, in registry, on top of the yellow image. Afterwards, the cyan master is corona charged, developed, metered, and the cyan image is transferred on-top of the two previous images. Finally the black master is corona charged, developed, metered, and the toned black image transferred, in registry, on top of the three previously transferred images. After the procedure is completed, the paper is carefully removed from the transfer station and the image fused for 15 seconds at 100° C.

The parameters used for preparation of the proof are: drum speed, 2.2 inches/sec (5.588 cm/sec); grid scorotron voltage, 100 to 200 V; scorotron current 200 to 400 μA (5.11 to 5.84 kV); metering roll voltage, 20 to 50 V; tackdown roll voltage, −2.5 to −5.0 kV; transfer corona current, 50 to 150 μA (4.35 to 4.88 kV); metering roll speed, 4 to 8 inches/sec (10.16 to 20.32 cm/sec); metering roll gap, 0.002 to 0.005 inch (~0.051 to 0.0127 mm); developer conductivity 12 to 30 picomhos/cm; developer concentration, 1 to 1.5% solids.

We claim:

1. In a high resolution, photohardenable electrostatic master comprising an electrically conductive substrate bearing a layer of a photohardenable composition consisting essentially of (a) an organic polymeric binder, (b) a compound having at least one ethylenically unsaturated group, and (c) a photoinitiator, the improvement wherein the photohardenable composition also contains (d) at least 0.1% by weight based on the total weight of the photohardenable composition of at least one organic electron acceptor compound or at least one organic electron donor compound to control the discharge characteristics of the photohardenable areas of the photohardenable layer.

2. A photohardenable electrostatic master according to claim 1 wherein at least one organic electron acceptor compound is present having an oxidation potential of less than +2.5 eV or at least one organic electron donor compound is present having a reduction potential larger than −3.0 eV.

3. A photohardenable electrostatic master according to claim 1 wherein the organic electron acceptor and donor compound is selected from the group consisting of

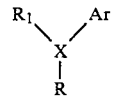

(1)

wherein R is alkyl or substituted alkyl of 1 to 12 carbon atoms, aryl of 6 to 10 carbon atoms, aryl of 6 to 10 carbon atoms substituted with alkyl of 1 to 12 carbon atoms, $NO_2$, halogen or alkoxy of 1 to 12 carbon atoms; $R_1$ is H, alkyl of 1 to 12 carbon atoms, aryl of 6 to 10 carbon atoms substituted with alkyl of 1 to 12 carbon atoms, $NO_2$, halogen, alkoxy of 1 to 12 carbon atoms; Ar is aryl of 6 to 10 carbon atoms, aryl of 6 to 10 carbon atoms substituted with alkyl of 1 to 12 carbon atoms, $NO_2$, halogen, alkoxy of 1 to 8 carbon atoms, and Ar can be connected to $R_1$ by a bond when $R_1$ is aryl or substituted aryl; X is an element from Group 5 of the Periodic Table; X-R can be carbonyl; and (2) a polycyclic or substituted polycyclic aromatic compound.

4. A photohardenable electrostatic master according to claim 3 wherein the electron acceptor is trinitrofluorenone.

5. A photohardenable electrostatic master according to claim 3 wherein the electron acceptor is biphenyl.

6. A photohardenable electrostatic master according to claim 3 wherein the electron donor is triphenylamine.

7. A photohardenable electrostatic master according to claim 3 wherein the electron donor is triphenyl phosphine.

8. A photohardenable electrostatic master according to claim 3 wherein the electron donor is triphenyl antimony.

9. A photohardenable electrostatic master according to claim 3 wherein the electron donor is 9-ethyl carbazole.

10. A photohardenable electrostatic master according to claim 3 wherein the electron donor is methyl diphenyl amine.

11. A photohardenable electrostatic master according to claim 3 wherein the electron donor is dimethyl aniline.

12. A photohardenable electrostatic master according to claim 3 wherein the electron donor is naphthalene.

13. A photohardenable electrostatic master according to claim 3 wherein the electron donor is benzophenone.

14. A photohardenable electrostatic master according to claim 3 wherein the electron donor is diphenylamine.

15. A photohardenable electrostatic master according to claim 1 wherein the photoinitiator is a hexaarylbiimidazole compound.

16. A photohardenable electrostatic master according to claim 3 wherein the photoinitiator is a hexaarylbiimidazole compound.

17. A photohardenable electrostatic master according to claim 16 wherein the hexaarylbiimidazole compound is 2,2′,4,4′-tetrakis(o-chlorophenyl)-5,5′-bis(m,p-dimethoxyphenyl)-biimidazole.

18. A photohardenable electrostatic master according to claim 16 wherein the hexaarylbiimidazole compound is 2,2′-bis(o-chlorophenyl)-4,4′,5,5′-tetraphenylbiimidazole.

19. A photohardenable electrostatic master according to claim 16 wherein the hexaarylbiimidazole compound is 2,2′-bis(o-chlorophenyl)-4,4′,5,5′-tetrakis(m-methoxyphenyl)-biimidazole.

20. A photohardenable electrostatic master according to claim 1 wherein the photoinitiator is an anthraquinone compound.

21. A photohardenable electrostatic master according to claim 20 wherein the anthraquinone compound is 2-ethyl anthraquinone.

22. A photohardenable electrostatic master according to claim 1 wherein the photoinitiator is benzoin methyl ether.

23. A photohardenable electrostatic master according to claim 15 wherein (e) a chain transfer agent is present.

24. A photohardenable electrostatic master according to claim 16 wherein (e) a chain transfer agent is present.

25. A photohardenable electrostatic master according to claim 24 wherein the chain transfer agent is 2-mercaptobenzoxazole.

26. A photohardenable electrostatic master according to claim 24 wherein the chain transfer agent is 2-mercaptobenzimidazole.

27. A photohardenable electrostatic master according to claim 1 wherein the binder is polymethylmethacrylate.

28. A photohardenable electrostatic master according to claim 3 wherein the binder is polymethylmethacrylate.

29. A photohardenable electrostatic master according to claim 1 wherein the binder is poly(styrene/methylmethacrylate).

30. A photohardenable electrostatic master according to claim 3 wherein the binder is poly(styrene/methylmethacrylate).

31. A photohardenable electrostatic master according to claim 1 wherein the compound having at least one ethylenically unsaturated group is ethoxylated trimethylol propane triacrylate.

32. A photohardenable electrostatic master according to claim 1 wherein the electrically conductive substrate is aluminized polyethylene terephthalate.

33. A photohardenable electrostatic master according to claim 3 wherein the electrically conductive substrate is aluminized polyethylene terephthalate.

34. A photohardenable electrostatic master according to claim 33 wherein binder (a) is polymethylmethacrylate, ethylenically unsaturated compound (b) is ethoxylated trimethylol propane triacrylate, photoinitiator (c) is 2,2',4,4'-tetrakis(o-chlorophenyl)-5,5'-bis(m,p-dimethoxyphenyl) biimidazole, electron donor (d) is triphenylamine and the chain transfer agent (e) is 2-mercaptobenzoxazole or 2-mercaptobenzothiazole, both the photoinitiator (c) and chain transfer agent (e) are substantially free of components removable by recrystallization from a methylene chloride and methanol mixture.

35. A photohardenable electrostatic master according to claim 33 wherein a protective release layer is present on the photohardenable layer.

36. A photohardenable electrostatic master according to claim 35 wherein the release layer is polyethylene or polypropylene.

37. A photohardenable electrostatic master according to claim 1 imagewise exposed to actinic radiation and electrostatically charged, and toned in the charged areas by means of an electrostatic liquid developer.

38. A photohardenable electrostatic master according to claim 37 wherein the electrostatically charged areas of the master are charged by corona discharge.

39. A photohardenable master according to claim 37 wherein the electrostatically charged areas of the master are toned with an electrostatic liquid developer.

40. A photohardenable master according to claim 39 wherein the electrostatic liquid developer comprises a nonpolar liquid having a Kauri-butanol value of less than 30, a thermoplastic resin having an average particle size of less than 10 μm, and a nonpolar liquid soluble ionic or zwitterionic compound.

41. A photohardenable master according to claim 40 wherein the electrostatic liquid developer contains a colorant.

42. A photohardenable electrostatic master according to claim 3 wherein the electron donor is triphenyl arsenic.

43. A photohardenable electrostatic master according to claim 3 imagewise exposed to actinic radiation and electrostatically charged, and toned in the charged areas by means of an electostatic liquid developer.

44. A photohardenable electrostatic master according to claim 43 wherein the electrostatically charged areas of the master are charged by corona discharge.

45. A photohardenable master according to claim 43 wherein the electrostatically charged areas of the master are toned with an electrostatic liquid developer.

46. A photohardenable master according to claim 45 wherein the electrostatic liquid developer comprises a nonpolar liquid having a Kauri-butanol value of less than 30, a thermoplastic resin having an average particle size of less than 10 μm, and a nonpolar liquid soluble ionic or zwitterionic compound.

47. A photohardenable master according to claim 46 wherein the electrostatic liquid developer contains a colorant.

* * * * *